US008007258B2

(12) United States Patent
Huang

(10) Patent No.: US 8,007,258 B2
(45) Date of Patent: Aug. 30, 2011

(54) PORTABLE AIR PUMP

(76) Inventor: Ying-Che Huang, Chang-Hua (TW)

( * ) Notice: Subject to any disclaimer, the term of this patent is extended or adjusted under 35 U.S.C. 154(b) by 149 days.

(21) Appl. No.: 11/696,275

(22) Filed: Apr. 4, 2007

(65) Prior Publication Data

US 2008/0247884 A1 Oct. 9, 2008

(51) Int. Cl.
*F04B 53/12* (2006.01)

(52) U.S. Cl. ..... 417/547

(58) Field of Classification Search ..... 137/528, 137/512.3, 533.19, 533.17, 860; 417/525, 417/527, 546, 547, 552, 553
See application file for complete search history.

(56) References Cited

U.S. PATENT DOCUMENTS 1,398,310 A * 11/1921 Zannoth ..... 417/547
1,491,388 A * 4/1924 Foster ..... 417/468
3,819,302 A * 6/1974 Ohashi ..... 417/234
5,026,261 A * 6/1991 Jou ..... 417/555.1
5,051,073 A * 9/1991 Newbold ..... 417/526
5,127,804 A * 7/1992 Chappell ..... 417/231
5,165,876 A * 11/1992 Wang ..... 417/511
5,538,398 A * 7/1996 Elson ..... 417/53
6,017,196 A * 1/2000 Wu ..... 417/234
6,065,947 A * 5/2000 Wu ..... 417/526
6,602,061 B2 * 8/2003 Chuang ..... 417/572
6,988,510 B2 * 1/2006 Enerson ..... 137/533.31
2006/0272497 A1 * 12/2006 Adams ..... 92/109
2007/0110589 A1 * 5/2007 Marafino ..... 417/231

* cited by examiner

*Primary Examiner* — Devon C Kramer
*Assistant Examiner* — Bryan Lettman

(57) ABSTRACT

A portable air pump includes a tubular body, a barrel, a piston mechanism, a head, and a dispensing head. The tubular body has an upper cover having air inlet holes and a sealed bottom cover. The barrel has an air passage running through it along its axis direction. The piston has a center hole and a through hole, and a check valve is in positioned between the second end of the barrel and the bottom end of the piston. As the tubular body is moved in relation to the barrel away from the head, air flows into the tubular body through the air inlet holes and to the bottom of the tubular body through the through hole. Air is prevented from flowing out through the center hole of the piston by use of a check valve disc. As the tubular body is moved in relation to the barrel towards the head, air in the bottom of tubular body flows into the air passage of the barrel through the center hole, and out through the head and the dispensing head.

4 Claims, 7 Drawing Sheets

PORTABLE AIR PUMP

BACKGROUND OF THE INVENTION

1. Field of the Invention

The present invention relates to an air pump for inflating air-inflatable objects (such as a tire), and in particular, to an air pump having advantages such as occupying a smaller volume and is portable.

2. The Prior Arts

Generally, the conventional air pump mainly includes an inflating pump, a head for connecting with the inflating pump, and a dispensing head, in which one end is connected with the head. After the other end of the dispensing head is connected with an air valve of the inflated object, the inflating pump can be operated so as to produce compressed air, and then the air can be inflated into the inflated object through the head and an air hose.

For the sake of allowing for easier carrying portability, several air pumps have been designed to occupy a smaller volume, such as a conventional air pump as shown in FIG. 6, which includes a tubular body A, a handle B, a head C, a nosepiece D which is positioned on the head, and a lever E. When to inflate an object, the nosepiece D is configured onto an inflating valve of the inflated object, and then the lever E is rotated to force a clamping member inside the air pump to be compacted for clamping the inflating valve tightly. Then the user can hold the handle B, and move it in the axis direction of the tubular body A, so that the air can be inflated into the inflating valve through the head C and the nosepiece D.

But the above conventional air pump has many disadvantages described as follows. During the inflating process, the air may be discharged due to leakage while operating the lever to engage and disengage the nosepiece D onto the air valve of the tire; and the nosepiece may be loosened from the inflating valve as the air pressure in the tubular body becomes too high. In addition, when the air pump is used, the user is required to hold the tubular body by one hand and to hold the handle by using the other hand, so that the entire length of the air pump can not be reduced, and because the dimensions of the air pump remains to be too big, therefore, it is inconvenient for carrying.

SUMMARY OF THE INVENTION

A main objective of the present invention is to resolve some of the problems of the conventional portable air pump, such as having disadvantages of excessive volume and inconvenient for carrying. In addition, the conventional portable air pump has the problem of easily discharging air leakage when engaging and disengaging the nosepiece onto the inflating valve when operating the lever. Furthermore, the nosepiece may be easily loosened as the air pressure in the tubular body becomes too high.

Another objective of the present invention is to form a tubular body of an air pump that can also be used as a handle. A piston mechanism and a barrel are to be assembled inside the tubular body. Furthermore, the piston mechanism includes a piston, a check valve seat, and a check valve disc. The check valve seat and the check valve disc are used for preventing gas or air from flowing in the reverse direction. When the air pump is not being used, the entire barrel can be retreated inside the tubular body, so that the overall volume of the air pump can be reduced to as small as possible, and it is more convenient for carrying or for storage.

The dispensing head is connected with the inflating valve of the inflated objects by means of a threaded connection.

Therefore, as compared to the conventional air pump, the connecting means of the present invention is not only easier, but also tighter, so that the dispensing head is not easily loosened under higher gas pressure. Furthermore, the inflating valve used in the screw-on type connecting method occupies a smaller volume, and can be more easily operated.

The portable air pump of the present invention includes a tubular body, a barrel, a piston mechanism, a head, and a dispensing head. The first end of the tubular body is formed with a plurality of air inlet holes. In addition, the second end of the tubular body is sealed. The barrel has an air passage that runs through the first end to the second end of the barrel. Furthermore, the piston mechanism includes a piston, and a check valve. The piston is disposed at the second end of the barrel. The check valve is disposed in between the second end of the barrel and the piston, and making the piston and the second end of the barrel to be disposed inside the tubular body. The piston has a center hole and a through hole. The head is disposed at the first end of the barrel. The dispensing head is disposed at the head. As the tubular body is moved along the axis direction of the barrel and in the direction away from the head, air is flown into the tubular body through the air inlet holes of the upper cover, and then to the bottom of the tubular body through the through hole of the piston; and the check valve disc is used for preventing air to flow through the center hole. As the tubular body is moved in the direction towards the head in relation to the barrel, the air at the bottom end of the tubular body is to flow into the air passage of the barrel, and then flown out from the head and the dispensing head.

The check valve includes a check valve seat and a check valve disc. Furthermore, the check valve includes a check valve seat having a stepped tubular body, one end of which is inserted into the air passage of the second end of the barrel and the other end of which is inserted into the piston; and a check valve disc, which is positioned inside the check valve seat, and the check valve disc is able to move in between the center hole of the piston and the central hole of the check valve seat.

In order to avoid collision of the tubular body of the air pump for producing a noise or causing damage as the tubular body is moved in relation to the barrel along the axis direction, buffer rings can be used in the present invention, which can be disposed on the barrel at the inside or outside of the tubular body. More specifically, the buffer rings are adjacent to the head and the piston, respectively, so that as the tubular body moves in the forward (inflating) stoke to a limit position, the piston can be avoided from colliding with the upper cover on the tubular body directly; and as the tubular body moves in the back stoke, the head can be avoided from colliding with the upper cover.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Reference will now be made in detail to embodiments of the present invention, examples of which are illustrated in the accompanying drawings. The present invention will be apparent to those skilled in the art by reading the following detailed description of a preferred embodiment and the skilled can operate it according to the reference.

Figure 1:
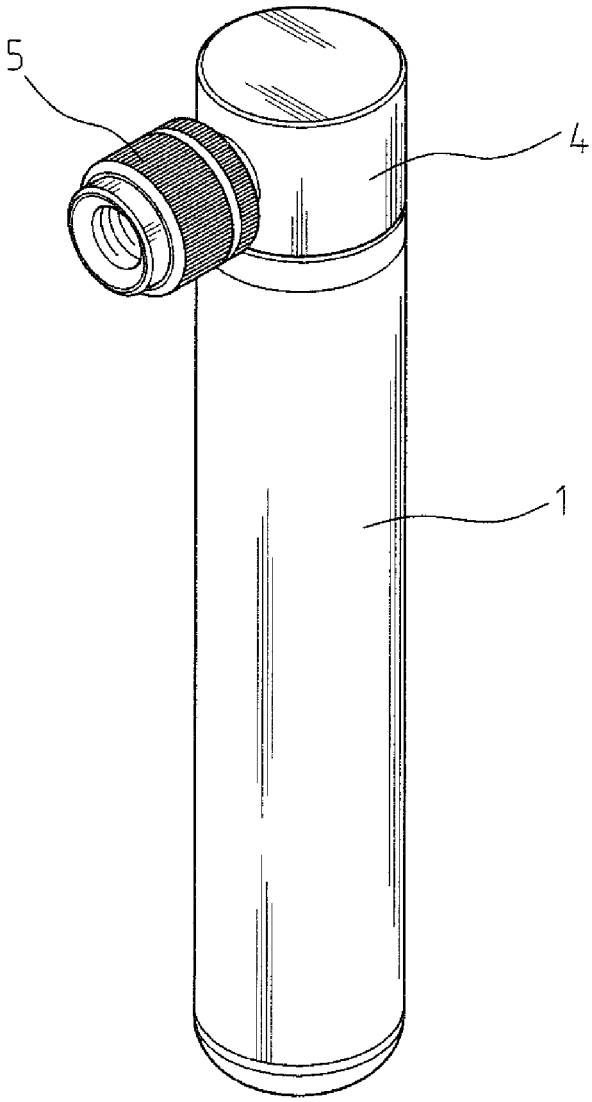
FIG. 1 is a perspective view showing a portable air pump according to an embodiment of the present invention.
Figure 2:
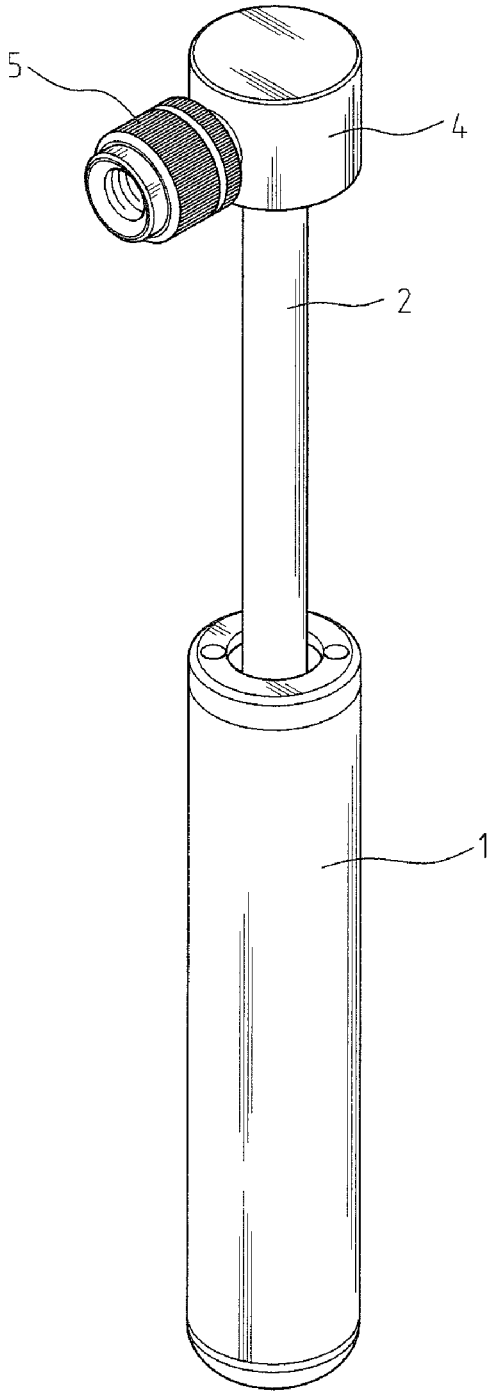
FIG. 2 is a perspective view showing a tubular body in a stretched form in relation to the barrel according to the embodiment of the present invention.

FIG. 1 and FIG. 2 are a plurality of perspective views showing a portable air pump according to an embodiment of the present invention, which includes a tubular body 1, a barrel 2 penetrating through the tubular body 1, a head 4 disposed on the barrel 2, and a dispensing head 5 disposed to the head 4. The barrel 2 and the tubular body 1 can move relative to one another along the axis direction, so that the air can be pushed out through the head 4 and the dispensing head 5.

Figure 3:
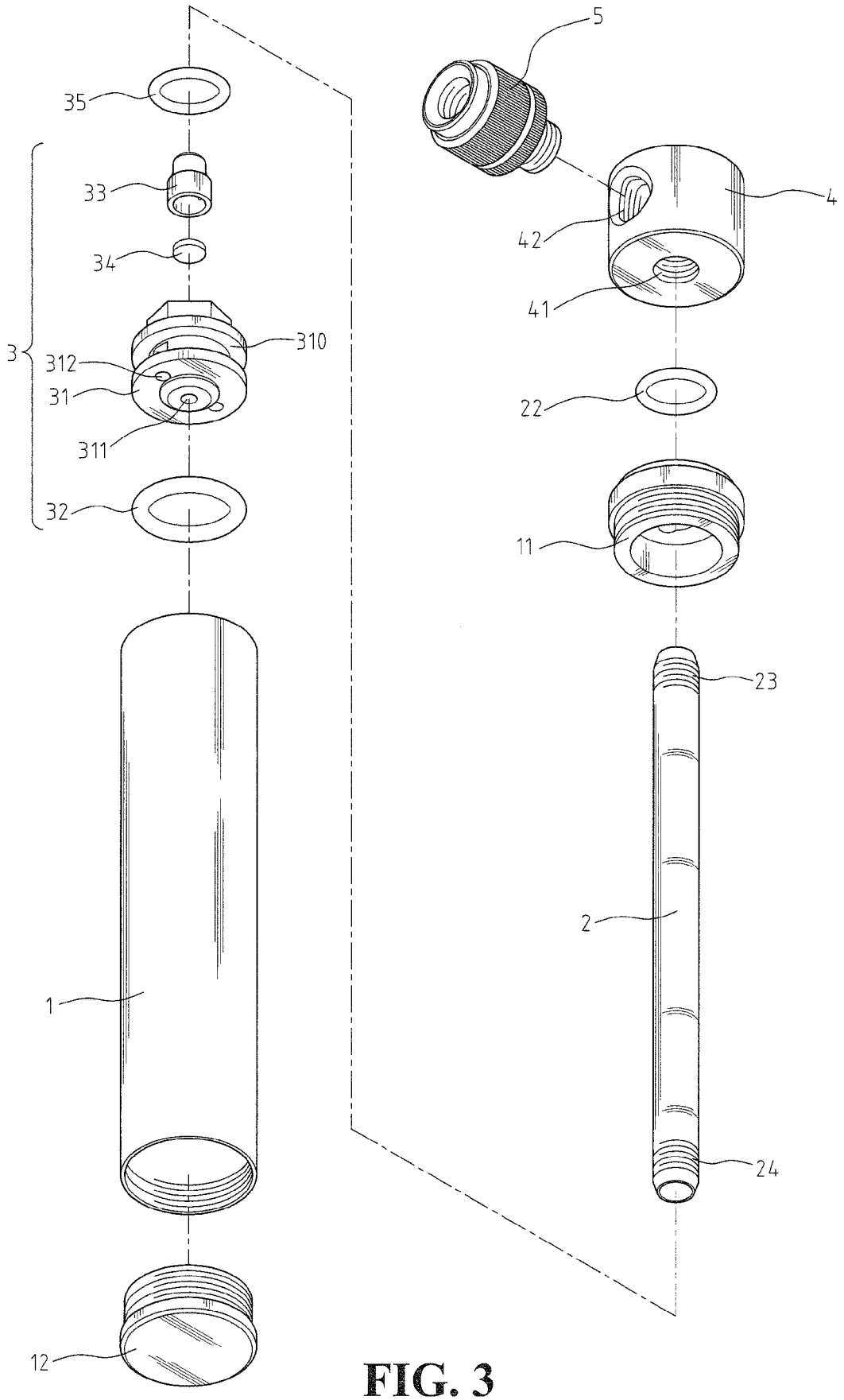
FIG. 3 is a perspective exploded view showing the assembling relationship of a plurality of major elements according to a preferred embodiment of the present invention.
Figure 4A:
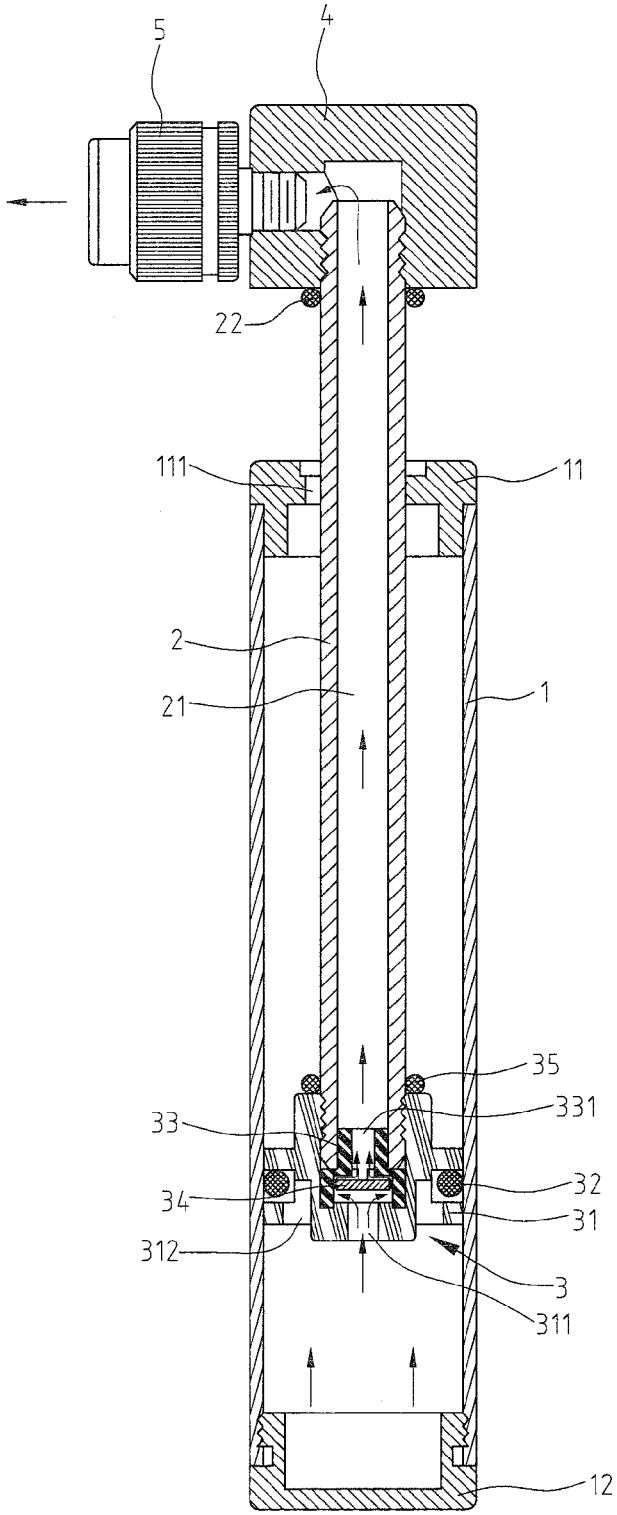
FIG. 4A is a cross-sectional view showing the inflating stroke as the air is being inflated out of the tubular body by operating the tubular body according to the preferred embodiment the present invention.
Figure 4B:
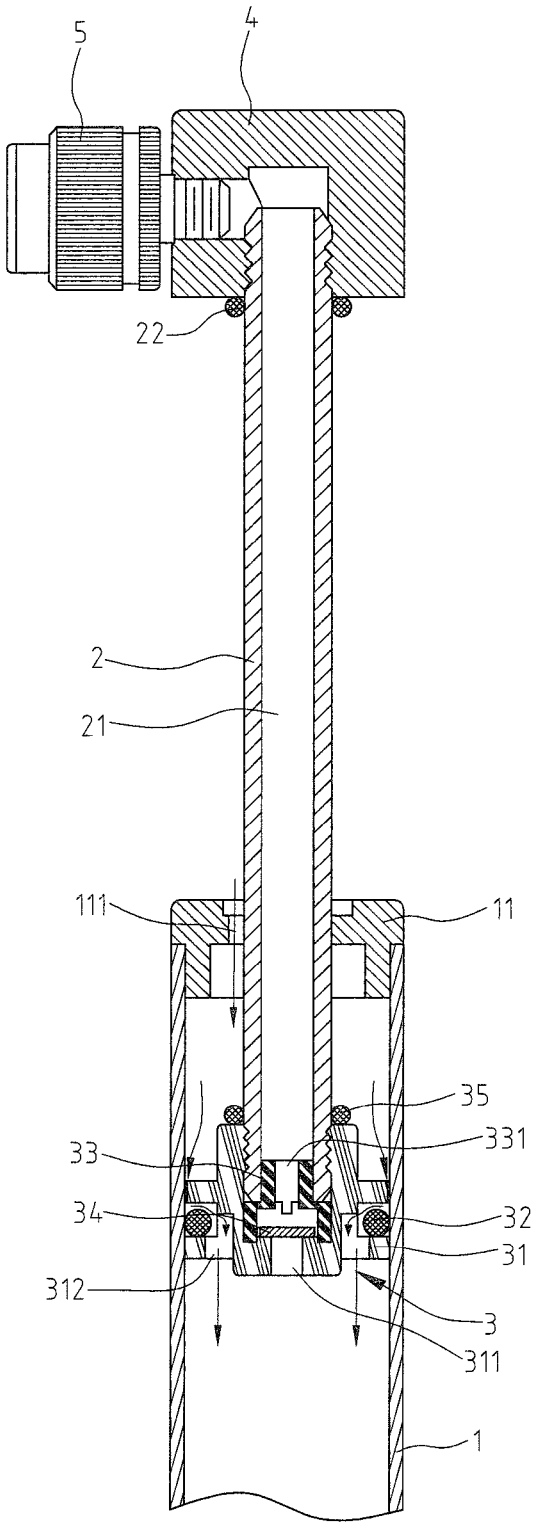
FIG. 4B is a cross-sectional view showing the back stroke as the air is being sucked into the tubular body by operating the tubular body according to the preferred embodiment the present invention.

FIG. 3 and FIGS. 4A-4B are a plurality of schematic diagrams illustrating a preferred embodiment according to the present invention, which show the method of assembly and structures of a plurality of major elements of the preferred embodiment of the present invention. The major elements include a tubular body 1, a barrel 2, a piston mechanism 3, a head 4, and a dispensing head 5. In the preferred embodiment of the present invention, the tubular body 1 is of a hollow tubular body, whose two ends are respectively formed with a plurality of internal threads. Also, the upper end of the tubular body 1 is screwed on with an upper cover 11 having threads, and a plurality of air inlet holes 111 are disposed on the upper cover 11; and the lower end of the tubular body 1 is screwed on with a bottom cover 12 having threads for sealing the bottom end of the tubular body 1.

The barrel 2 has a hollow tubular body, whose external diameter is smaller than the internal diameter of the tubular body 1, and the first and second ends of the barrel 2 are formed with a first outer screw thread 23 and a second outer screw thread 24, respectively. Also, the hollow space inside the barrel 2 is of an air passage 21 that runs through the first end and the second end of the barrel 2.

Furthermore, the piston mechanism 3 includes a piston 31 and a check valve. The outer diameter of the piston 31 is formed with an annulus groove 310; and the center of the piston 31 is formed with a center hole 311. Furthermore, the upper end of the piston 31 is screwed on and engaged with the second outer screw thread 24 of the second end of the barrel 2. A plurality of through holes 312 running to the annulus groove 310 is formed on the bottom of the piston 31. Furthermore, a piston ring 32 is positioned to engage with the annulus groove 310.

In addition, the check valve includes a check valve seat 33 and a check valve disc 34. The check valve seat 33 has a stepped tubular body and a central hole 331. The check valve disc 34 has a soft body and is disposed inside the larger inner diameter of the check valve seat 33. Thus, the check valve disc 34 can move in the central hole 331 of the check valve seat 33. After the second end of the barrel 2 is fitted with a second buffer ring 35, an end of the check valve seat 33 which has a smaller outer diameter is positioned inside the inner diameter of the second end of the barrel 2. Then, after the check valve disc 34 is disposed inside the other end of the check valve seat 33 having a larger outer diameter, the check valve seat 33 is positioned into the upper end of the piston 31. Then, the upper end of the piston 31 is screwed on and engaged with the second outer screw thread 24 of the barrel 2.

Furthermore, the head 4 has a gas passage running through its bottom surface and side surface, on the two ends of which, a first screw hole 41 and a second screw hole 42 are formed, respectively. After the first end of the barrel 2 is fitted with a first buffer ring 22, the first outer screw thread 23 is engaged with the first screw hole 41 of the head 4, and thus the gas passage of the head 4 is communicated with the air passage 21 of the barrel 2.

Figure 5:
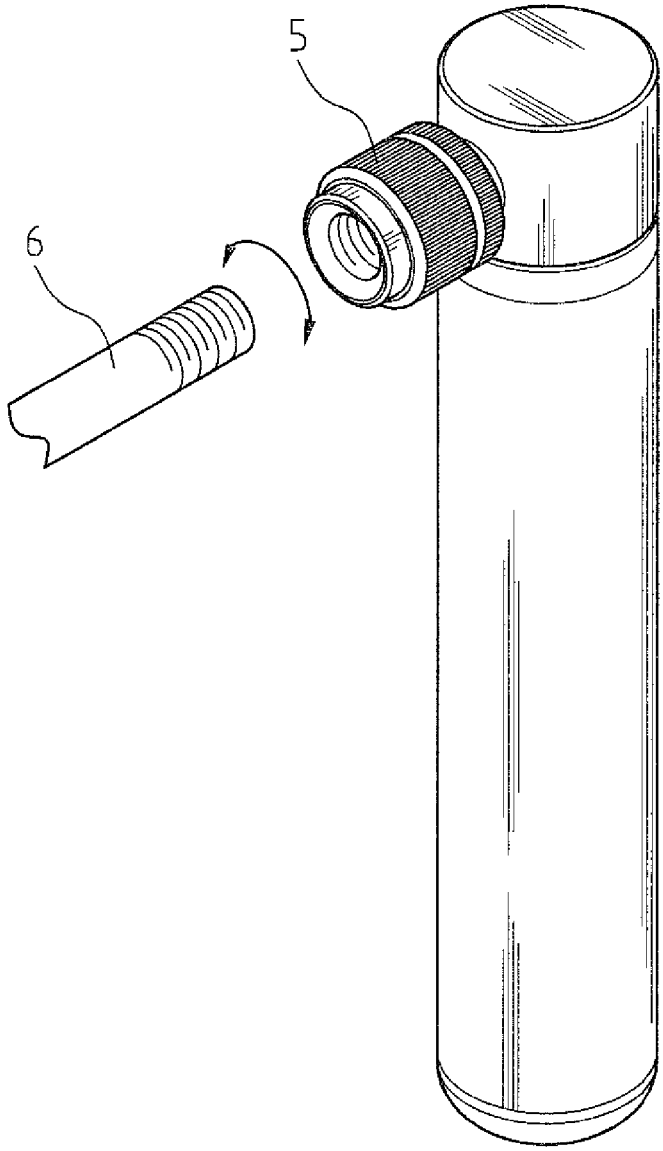
FIG. 5 is a perspective view showing the connecting of the portable air pump with an inflating valve, according to the embodiment of the present invention.
Figure 6:
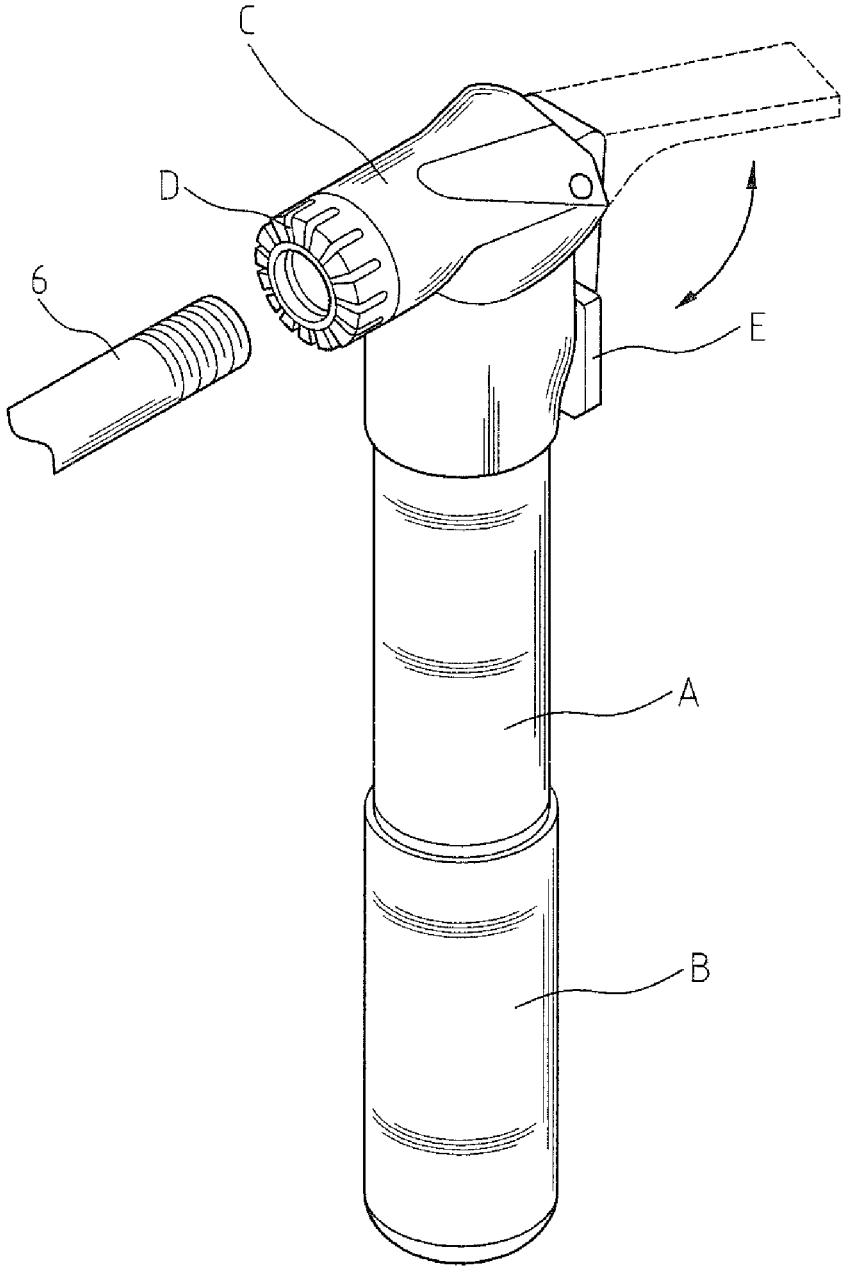
FIG. 6 (Prior Art)
FIG. 6 is a perspective view showing a conventional portable air pump.

In the embodiment, the dispensing head 5 is a screw-on swivel head, in which one end is engaged with the second screw hole 42 of the head 4, and the other end of the dispensing head 5 can be engaged with the inflating valve 6 of the inflated objects (with reference to FIG. 5).

FIG. 4A and FIG. 4B are illustrative of the respective movements and air flow during an inflating process or stroke using the portable air pump according to the present invention. As the user is holding the tubular body 1 and moving the tubular body 1 at the direction towards the head 4 along the axis direction of the barrel 2, the check valve disc 34 is pressed by the air pressure and is moved towards the upper end of the check valve seat 33. But because of the side holes formed on the lower portion of the central hole 331 of the check valve seat 33, the central hole 331 cannot be totally closed by the check valve disc 34; therefore, the air in the bottom end of the tubular body 1 can flow into the air passage 21 of the barrel 2 through the center hole 311 of the piston 31 and the central hole 331 of the check valve seat 33, and then to flow out from the head 4 and the dispensing head 5 so as to inflate the objects (with reference to FIG. 4). As the tubular body 1 is moved along the axis direction of the barrel 2, and in the direction away from the head 4, the air can be flown into the tubular body 1 through the air inlet holes 111 of the upper cover 11, and then flown to the bottom of the tubular body 1 through the through holes 312 of the piston 31 (with reference to FIG. 4B) so as to be ready for the next inflating stroke.

During the inflating stroke, the upper cover 11 may collide with the head 4 to produce a noise or damage the air pump. So in the embodiment of the present invention, the first buffer ring 22 is used as a buffering member between the head 4 and the upper cover 11 for avoiding the above problem. Also, in the back stroke, the upper cover 11 may also collide with the piston 31 to produce a noise or damage the air pump, so the second buffer ring 35 is used as the buffering member between the piston 31 and the upper cover 11 for avoiding the problem. Referring to FIGS. 4A-4B, the first buffer ring 22 is disposed at the connecting location between the outer diameter of the first end of the barrel 2 and the head 4; the second buffer ring 35 is disposed at the connecting location between the outer diameter of the second end of the barrel 2 and the piston 31.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A portable air pump comprising:

an external tubular body including first and second ends, the external tubular body having an upper cover at the first end, the upper cover comprising a plurality of air inlet holes, the external tubular body further having a bottom cover at the second end of the external tubular body for sealing the second end;

a barrel comprising first and second ends and an air passage running through the first end to the second end of the barrel in an axis direction;

a piston mechanism comprising a piston and a check valve, the piston being disposed on the second end of the barrel, a piston ring being engaged with an outer diameter of the piston, the check valve being disposed in between the second end of the barrel and the piston, the piston and the second end of the barrel being disposed inside the external tubular body with the first end of the barrel extending out of the external tubular body, the piston comprising a center hole and at least one through hole formed on a bottom surface, the center hole being in communication with said at least one through hole via a space in the external tubular body between the piston and the bottom cover, the second end of the barrel being received in an end of the center hole of the piston, the center hole of the piston further including an other having an inner diameter, the inner diameter of the other end of the center hole of the piston being smaller than an inner diameter of the end of the center hole of the piston;

the check valve comprising:

a check valve seat comprising a stepped tubular body and a central hole, the other end of the center hole of the piston being spaced from the second end of the barrel, the check valve seat completely received in the center hole of the piston, one end of the check valve seat being inserted into the air passage at the second end of the barrel, and an other end of the check valve seat being inserted into the end of the center hole of the piston, the central hole of the check valve seat being in communication with and between the air passage of the barrel and the other end of the center hole of the piston, the other end of the check valve seat having a face abutting an end face of the second end of the barrel, the other end of the check valve seat further having an outer periphery perpendicular to the face of the other end of the check seat and flush with an outer periphery of the second end of the barrel, the piston having an inner periphery engaged with the outer periphery of the second end of the barrel and the outer periphery of the other end of the check valve seat, with the inner periphery of the piston being not in contact with the end face of the second end of the barrel, the end of the check valve seat abutting an inner periphery of the second end of the barrel, and a check valve disc disposed inside the stepped tubular body of the check valve seat, the check valve disc being movable between first and second positions in the central hole of the check valve seat, the check valve disc having an outer diameter larger than the inner diameter of the other end of the center hole of the piston, the other end of the center hole of the piston and the central hole of the check valve seat being not closed by the check valve disc when in the first position, the other end of the center hole of the piston being closed by the check valve disc when in the second position, preventing air from flowing through the end of the center hole of the piston to the air passage of the barrel via the central hole of the check valve seat;

a head comprising an air passage running through a bottom surface and a side surface of the head, the head being disposed at the first end of the barrel, the air passage of the head being connected to the air passage of the barrel; and a dispensing head disposed at the head and being connected to the air passage of the head, wherein as the external tubular body moves in relation to the barrel in a direction away from the head, the check valve disc is in the second position, air flows into the external tubular body through the plurality of air inlet holes of the upper cover and then flows into the space in the external tubular body between the bottom cover and the piston through said at least one through hole of the piston, and wherein as the external tubular body moves in relation to the barrel in a direction towards the head, the check valve disc is in the first position, air flows from the space in the external tubular body in a direction away from the bottom cover of the external tubular body into the air passage of the barrel through the center hole of the piston and the central hole of the check valve seat and then flows out from the head and the dispensing head.

2. The portable air pump as claimed in claim 1, wherein a first buffer ring is disposed at a connecting location on an outer diameter of the first end of the barrel adjacent the head, and a second buffer ring is disposed at a connecting location on an outer diameter of the second end of the barrel adjacent the piston.

3. The portable air pump as claimed in claim 1, wherein the stepped tubular body comprises:

a first tubular member disposed within the end of the center hole of the piston, the first tubular member including the face abutting the end face of the second end of the barrel, the first tubular member further including the outer periphery flush with the outer periphery of the second end of the barrel, and a second tubular member disposed within the second end of the barrel and having a diameter less than the first tubular member, the first and second tubular members being arranged concentrically, the second tubular member abutting the inner periphery of the second end of the barrel, the central hole of the check valve seat extending through the first and second tubular members and having a first diameter within the first tubular member and a second diameter within the second tubular member, the first diameter of the central hole being greater than the second diameter of the central hole, the check valve disc being disposed inside the first tubular member and being movable between the first and second positions along the axis direction, the check valve disc being positionable in the first position intermediate the second tubular member and the other end of the center hole of the piston as the tubular body moves in relation to the barrel in the direction toward the head and being positionable in the second position at a distance from the second tubular member and within the first tubular member to seal the other end of the central hole of the piston as the external tubular body moves in relation to the barrel in the direction away from the head.

4. The portable air pump as claimed in claim 1, wherein air passages are formed in a lower portion of the central hole of the check valve seat to allow air to enter the barrel when the check valve disc is positioned in the first position.

* * * * *